US009609933B2

(12) United States Patent
Cefaratti

(10) Patent No.: US 9,609,933 B2
(45) Date of Patent: Apr. 4, 2017

(54) POWDER DISPENSING DEVICE

(71) Applicant: Frank Cefaratti, Fort Lauderdale, FL (US)

(72) Inventor: Frank Cefaratti, Fort Lauderdale, FL (US)

( * ) Notice: Subject to any disclaimer, the term of this patent is extended or adjusted under 35 U.S.C. 154(b) by 0 days.

(21) Appl. No.: 14/197,240

(22) Filed: Mar. 5, 2014

(65) Prior Publication Data

US 2016/0000205 A1 Jan. 7, 2016

(51) Int. Cl.
*A45D 33/36* (2006.01)
*A45D 33/16* (2006.01)
*A45D 33/00* (2006.01)

(52) U.S. Cl.
CPC ..... *A45D 33/16* (2013.01); *A45D 33/005* (2013.01); *A45D 33/36* (2013.01)

(58) Field of Classification Search
CPC ..... A45D 33/00; A45D 33/34; A45D 33/36
USPC ..... 401/200, 265, 196, 266
See application file for complete search history.

(56) References Cited

U.S. PATENT DOCUMENTS 5,931,591 A * 8/1999 McCracken ..... A45D 34/04 401/205
6,523,550 B2 * 2/2003 McCormick ..... A45D 34/04 132/320
6,550,996 B1 * 4/2003 Rayfield ..... A45D 40/00 401/206
6,805,570 B1 * 10/2004 Lee ..... G06K 7/0082 439/108

* cited by examiner

*Primary Examiner* — David Walczak
*Assistant Examiner* — Joshua Wiljanen
(74) *Attorney, Agent, or Firm* — Caesar Rivise, PC

(57) ABSTRACT

A powder dispensing device for dispensing powder may include a powder application device for dispensing the powder and a handle connected to the powder application device to allow the user to manipulate the power dispensing device. The power application device may include a cavity having access by a detachable lid to store the powder and may include a flexible powder dispensing housing being permeable to dispense the powder from the cavity. The powder application device may include a bottom wall having apertures to connect the cavity with the powder dispensing housing. A handle may include a hook. The powder application device may include a curved front wall. The powder application device may include a curved back wall. The power application device may include a curved sidewall.

6 Claims, 2 Drawing Sheets

POWDER DISPENSING DEVICE

FIELD OF THE INVENTION

The present invention relates to a cosmetic container, more particularly to a cosmetic container for applying powder.

BACKGROUND

Cosmetics are increasingly important at formal occasions, to the point where they have become basic manners.

A conventional cosmetic container has a container body, a housing, a rotating body and a brush.

The container body is for receiving powder. The housing is connected to an opening of the container body; moreover, the housing has a plurality of penetrating holes formed in a top thereof. The rotating body has a plurality of through holes formed in a top thereof and the plural through holes correspond to the plural penetrating holes of the housing. The brush is arranged on the rotating body.

The rotating body is rotated until the through holes of the rotating body completely coincide with the penetrating holes of the housing. Powder in the container body then flows out from the container body.

However, powder flow rate of the conventional cosmetic container is not controlled. Unnecessary powder flows out, which wastes too much powder.

Therefore, according to above descriptions, there are some issues of inconvenience, which need to be improved.

SUMMARY

A powder dispensing device for dispensing powder may include a powder application device for dispensing the powder and a handle connected to the powder application device to allow the user to manipulate the powder dispensing device.

The powder application device may include a cavity having access by a detachable lid to store the powder and may include a flexible powder dispensing housing being permeable to dispense the powder from the cavity.

The powder application device may include a bottom wall having apertures to connect the cavity with the powder dispensing housing.

A handle may include a hook.

The powder application device may include a curved front wall.

The powder application device may include a curved back wall.

The powder application device may include a curved sidewall.

The powder application device may be substantially oval shaped.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
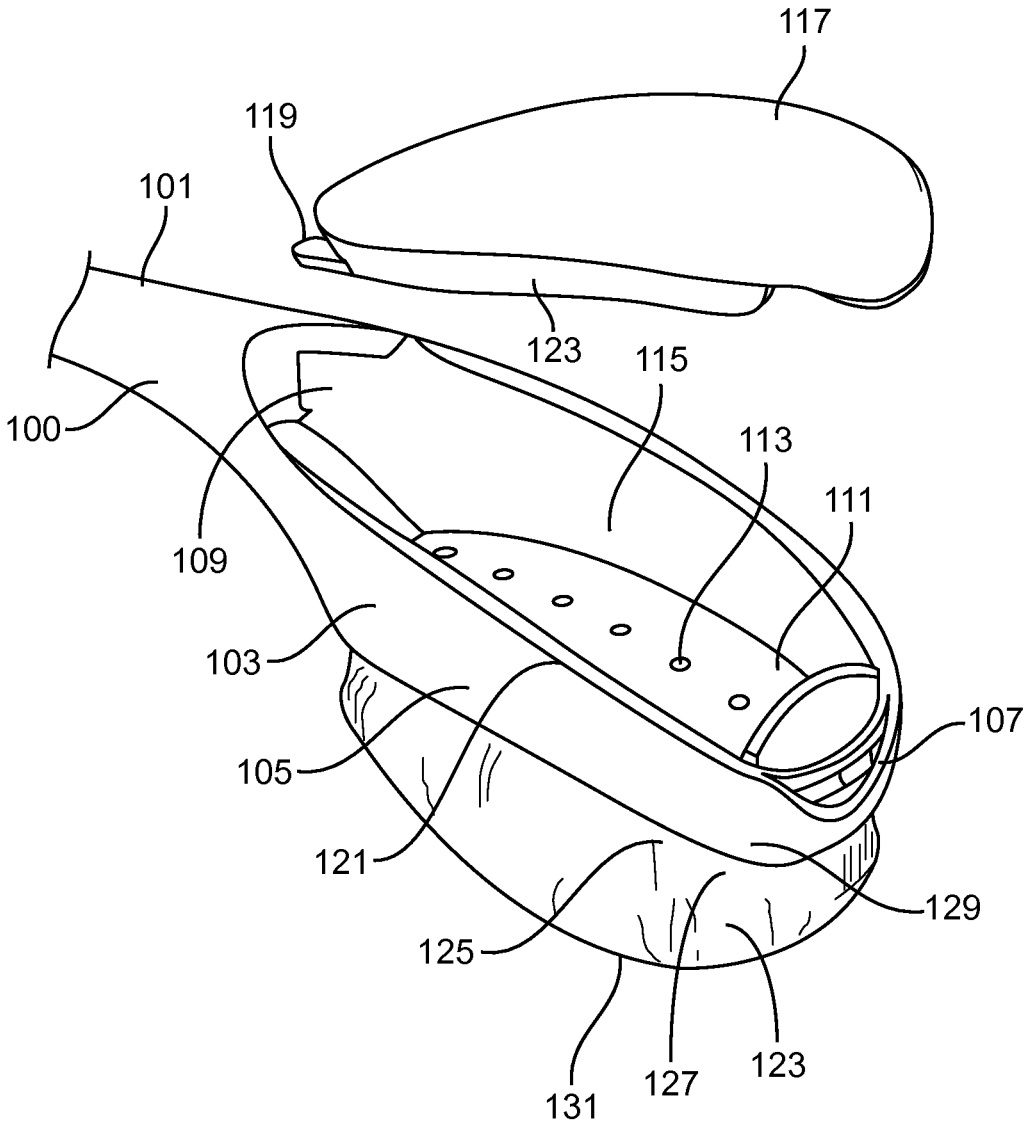
FIG. 1 illustrates an exploded view of the powder dispensing device of the present invention.

FIG. 1 illustrates a partial exploded perspective view of the powder dispensing device 100, and FIG. 1 may illustrate that the distal end of the handle 101 may be connected to a powder application device 103. The powder application device 103 may be substantially oval in shape and may be formed from metal, plastic, wood or other rigid material and may include a pair of opposing near mirror sidewalls 105, a front wall 107 which may connect to the side walls 105 and may be curved, a back wall 109 which may connect to the side walls, which may connect to the handle 101 and may be curved, a bottom wall 111 which may connect to the side walls 105, the front wall 107 and the back wall 109 and which may be substantially planar and may include apertures 113 to allow powder which may be stored in the cavity 115 which may be defined by the side walls 105, the front wall 107, the back wall 109, the bottom wall 111 and the top wall 117 which may be a detachably connected lid. The top wall 117 may include a retaining finger 119 which may extend from the top wall 117 to retain the top wall 117 over the cavity 115. The front wall 107, back wall 109 and sidewall 105 may include an inclined edge 121 to cooperate with an inclined edge 123 of the top wall 117 to form a seal to retain the powder within the cavity 115.

FIG. 1 illustrates that the powder application device 103 may include a flexible powder dispensing housing 123 which may include a lip 125 which may extend around the housing side wall 127 to cooperate with a sidewall channel 129 which may be formed around the sidewall 105, the front wall 107 and the back wall 109 in order to retain the flexible powder dispensing housing 123. The aperture 113 in the bottom wall 117 may allow the powder to move from the cavity 119 to the flexible powder dispensing housing 123. The flexible powder dispensing housing 123 may include a housing bottom wall 131 which may be connected to the housing side wall 127. The flexible powder dispensing housing 123 may be formed from flexible material such as cloth, sponge, fur or other flexible material which may be permeable for the powder to move from the flexible powder dispensing housing 103 to the user.

Figure 3:
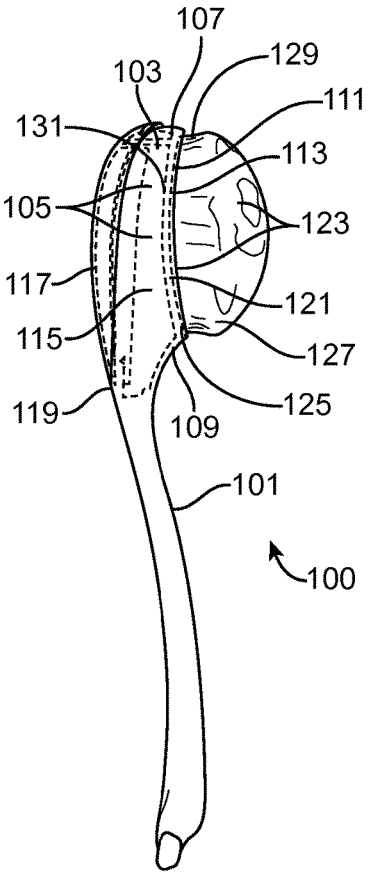
FIG. 3 illustrates a side perspective view of the powder dispensing device of the present invention.

FIG. 3 illustrates a side perspective view of the powder dispensing device 100, and FIG. 3 may illustrate that the distal end of the handle 101 may be connected to a powder application device 103. FIG. 3 illustrates a curved handle 101 which may be ergonomically designed. The powder application device 103 may be substantially oval in shape and may be formed from metal, plastic, wood or other rigid material and may include a pair of opposing near mirror sidewalls 105, a front wall 107 which may connect to the side walls 105 and may be curved, a back wall 109 which may connect to the side walls, which may connect to the handle 101 and may be curved, a bottom wall 111 which may connect to the side walls 105, the front wall 107 and the back wall 109 and which may be substantially planar and may include apertures 113 to allow powder which may be stored in the cavity 115 which may be defined by the side walls 105, the front wall 107, the back wall 109, the bottom wall 111 and the top wall 117 which may be a detachably connected lid. The top wall 117 may include a retaining finger 119 which may extend from the top wall 117 to retain the top wall 117 over the cavity 115. The front wall 107, back wall 109 and sidewall 105 may include an inclined edge 121 to cooperate with an inclined edge 123 of the top wall 117 to form a seal to retain the powder within the cavity 115.

Figure 4:
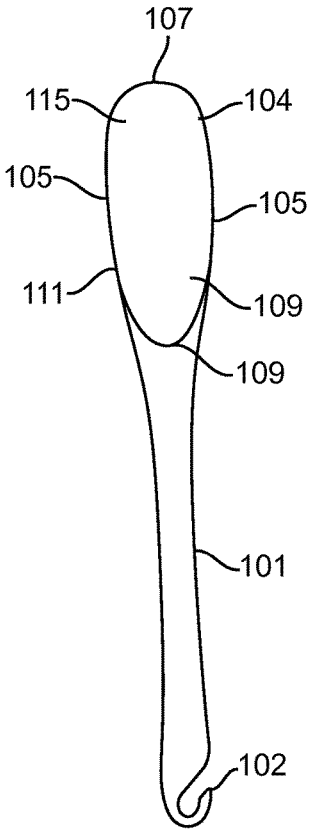
FIG. 4 illustrates a back view of the powder dispensing device of the present invention.

FIG. 3 illustrates that the powder application device 103 may include a flexible powder dispensing housing 123 which may include a lip 125 which may extend around the housing side wall 127 to cooperate with a sidewall channel 129 which may be formed around the sidewall 105, the front wall 107 and the back wall 109 in order to retain the flexible powder dispensing 123. The aperture 113 in the bottom wall 117 may allow the powder to move from the cavity 119 to the flexible powder dispensing housing 123 which may be hollow. The flexible powder dispensing housing 123 may include a housing bottom wall 131 which may be connected to the housing side wall 127. The flexible powder dispensing housing 123 may be formed from flexible material such as cloth, sponge, fur or other flexible material which may be permeable for the powder to move from the flexible powder dispensing housing 103 to the user. FIG. 4 additionally illustrates that the handle 101 may include an application tool 104 at the proximate end of the handle 101.

Figure 5:
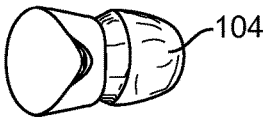
FIG. 5 illustrates a partial view of a application tool of the powder dispensing device.

FIG. 5 illustrates a sectional view of the application tool 104.

Figure 2:
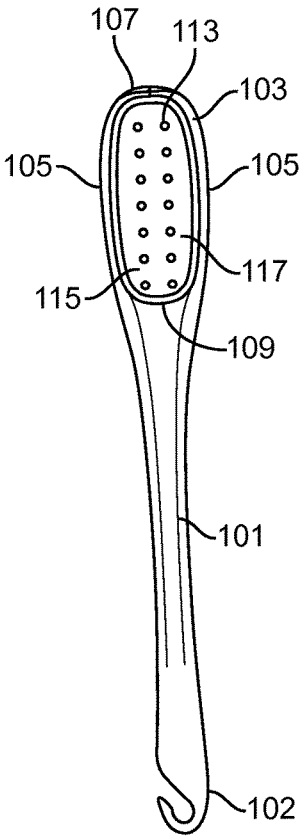
FIG. 2 illustrates a front view of the powder dispensing device of the present invention.

FIG. 2 illustrates the handle 101, the powder application device 103, the sidewall 105, the top wall 107, the back wall 109, the cavity 115, the bottom wall 111 and the aperture 113. FIG. 2 additionally illustrates that the handle 101 may include a hook 102 at the proximate end of the handle 101.

FIG. 4 illustrates the handle 101, the sidewall 105, the top wall 107, the back wall 109, the cavity 115, the bottom wall 111. FIG. 4 illustrates that the handle includes a hook 102 at the proximate end of the handle 101.

Figure 6:
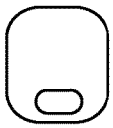
FIG. 6 illustrates an end view of the powder dispensing device of the present invention.

FIG. 6 illustrates an end view of the powder dispensing device of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A powder dispensing device for dispensing powder, comprising:

a powder application device and a powder to be dispensed included therein, said powder application device comprising a cavity having access by a lid, said powder being in said cavity, said powder application device further including a flexible powder dispensing housing that is permeable to dispense the powder included within the cavity and wherein the powder application device includes a bottom wall having apertures to connect the cavity with the flexible powder dispensing housing and wherein said apertures are arranged from a proximal end to a distal end of said powder dispensing housing along a longitudinal axis of said powder dispensing housing; and a handle having a distal end and a proximal end, wherein said distal end is adjacent said cavity and said proximal end is spaced from said cavity, said handle comprising a grasping portion that allows the user to manipulate the powder dispensing device, said distal end being connected to the powder application device.

2. A powder dispensing device for dispensing powder as in claim 1, wherein the handle includes a hook.

3. A powder dispensing device for dispensing powder as in claim 1, wherein the powder application device includes a curved front wall.

4. A powder dispensing device for dispensing powder as in claim 1, wherein the powder application device includes a curved back wall.

5. A powder dispensing device for dispensing powder as in claim 1, wherein the powder application device includes a curved sidewall.

6. A powder dispensing device for dispensing powder as in claim 1, wherein the powder application device is substantially oval shaped.

* * * * *